US009248932B2

(12) United States Patent
Gamber et al.

(10) Patent No.: US 9,248,932 B2
(45) Date of Patent: Feb. 2, 2016

(54) PRODUCT EVACUATION RIB

(71) Applicants: Dan Gamber, Lakeland, TN (US); Daniel M. Futral, Somerville, TN (US); Doug Dygert, Olive Branch, MS (US)

(72) Inventors: Dan Gamber, Lakeland, TN (US); Daniel M. Futral, Somerville, TN (US); Doug Dygert, Olive Branch, MS (US)

(73) Assignee: RING Container Technologies, LLC, Oakland, TN (US)

( * ) Notice: Subject to any disclaimer, the term of this patent is extended or adjusted under 35 U.S.C. 154(b) by 0 days.

(21) Appl. No.: 13/773,045

(22) Filed: Feb. 21, 2013

(65) Prior Publication Data

US 2013/0213984 A1 Aug. 22, 2013

Related U.S. Application Data

(60) Provisional application No. 61/601,279, filed on Feb. 21, 2012.

(51) Int. Cl.

| | |
|---|---|
| ***B65D 1/16*** | (2006.01) |
| ***B65D 1/44*** | (2006.01) |
| *B65D 1/12* | (2006.01) |
| *B65D 1/14* | (2006.01) |

(52) U.S. Cl.
CPC ... *B65D 1/44* (2013.01); *B65D 1/14* (2013.01); *B65D 2501/0018* (2013.01)

(58) Field of Classification Search
CPC ..... B65D 51/26; B65D 1/44; B65D 1/0223; B65D 1/10; B65D 1/14; A47G 19/22; A47G 19/2255; Y10S 215/00; Y10S 215/90
USPC ..... 220/672, 675, 669, 90.4; 215/381, 382, 215/384, 379
See application file for complete search history.

(56) References Cited

U.S. PATENT DOCUMENTS

| | | | | | |
|---|---|---|---|---|---|
| 1,835,252 | A | * | 12/1931 | West | 222/547 |
| 3,117,873 | A | * | 1/1964 | Bartels et al. | 426/131 |
| D235,184 | S | * | 5/1975 | Achenbach | D7/615 |
| 4,921,116 | A | * | 5/1990 | Troughton et al. | 220/672 |
| 4,936,482 | A | * | 6/1990 | Gallagher et al. | 220/802 |
| 5,137,171 | A | * | 8/1992 | Goeppner | 220/667 |
| 5,303,834 | A | * | 4/1994 | Krishnakumar et al. | 215/381 |
| 5,337,909 | A | * | 8/1994 | Vailliencourt | 215/381 |
| D381,259 | S | * | 7/1997 | Hayes | D9/454 |
| 5,730,315 | A | * | 3/1998 | Richoux | 220/672 |
| 5,803,290 | A | * | 9/1998 | Bongiorno | 215/384 |
| D399,129 | S | * | 10/1998 | Ramsey | D9/773 |
| D401,860 | S | * | 12/1998 | Mentasti Granelli | D9/538 |
| 5,908,128 | A | * | 6/1999 | Krishnakumar et al. | 215/381 |
| 6,273,282 | B1 | * | 8/2001 | Ogg et al. | 215/381 |
| 6,695,162 | B1 | * | 2/2004 | Boukobza et al. | 215/384 |
| 6,932,230 | B2 | * | 8/2005 | Pedmo et al. | 215/381 |
| D525,129 | S | * | 7/2006 | Hutter | D9/502 |
| D538,658 | S | * | 3/2007 | Horne et al. | D9/502 |
| 7,374,055 | B2 | * | 5/2008 | Hatcher et al. | 215/381 |
| D596,955 | S | * | 7/2009 | Diss | D9/500 |
| D596,957 | S | * | 7/2009 | Diss | D9/500 |

(Continued)

*Primary Examiner* — Mickey Yu
*Assistant Examiner* — Gideon Weinerth
(74) *Attorney, Agent, or Firm* — Sughrue Mion, PLLC

(57) ABSTRACT

A container for storing a food product, the container including a top opening for receiving a material, a side portion extending between the top opening and a bottom of the container. The container provides an inward projecting rib disposed on the side portion having an upper portion having a radius of curvature smaller than a bottom portion of the rib. The rib provides for increased hoop strength and facilitates product evacuation below the rib.

2 Claims, 4 Drawing Sheets

(56) References Cited

U.S. PATENT DOCUMENTS

| | | | | | |
|---|---|---|---|---|---|
| 7,748,552 | B2 * | 7/2010 | Livingston et al. | 215/381 |
| 7,757,874 | B2 * | 7/2010 | Ross | 215/381 |
| D630,515 | S * | 1/2011 | Bretz et al. | D9/520 |
| D632,189 | S * | 2/2011 | Diss | D9/556 |
| D638,311 | S * | 5/2011 | Diss | D9/500 |
| D646,169 | S * | 10/2011 | Bretz et al. | D9/520 |
| D650,703 | S * | 12/2011 | Westphal | D9/776 |
| 8,070,003 | B2 * | 12/2011 | True et al. | 215/382 |
| D653,125 | S * | 1/2012 | Murphy | D9/776 |
| D657,677 | S * | 4/2012 | Berzosa Sanchez | D9/500 |
| D661,203 | S * | 6/2012 | Murphy | D9/774 |
| D661,205 | S * | 6/2012 | Myers | D9/776 |
| 8,496,130 | B2 * | 7/2013 | Lane et al. | 215/381 |
| 8,505,758 | B2 * | 8/2013 | Oshino | 215/382 |
| D721,586 | S * | 1/2015 | Sharpe et al. | D9/500 |
| 2004/0200799 | A1 * | 10/2004 | Yourist et al. | 215/381 |
| 2005/0121408 | A1 * | 6/2005 | Deemer et al. | 215/381 |
| 2006/0283832 | A1 * | 12/2006 | De Cleir et al. | 215/383 |
| 2007/0199916 | A1 * | 8/2007 | Denner et al. | 215/381 |
| 2011/0266293 | A1 * | 11/2011 | Kelley et al. | 220/672 |
| 2012/0074151 | A1 * | 3/2012 | Gill et al. | 220/669 |
| 2014/0091101 | A1 * | 4/2014 | Chiorazzi et al. | 220/669 |

* cited by examiner

DETAIL B

PRODUCT EVACUATION RIB

CROSS-REFERENCE TO RELATED PATENT APPLICATION

This application claims the benefit of U.S. Provisional Patent Application No. 61/601,279 filed Feb. 21, 2013 in the U.S. Patent Trademark Office, the disclosure of which is incorporated herein in its entirety by reference.

BACKGROUND OF THE INVENTION

1. Field of the Invention

The present invention relates to a container having ribs designed to improve product evacuation from the container.

2. Description of the Related Art

When certain products are stored in plastic containers, these products become oxygen scavengers. This scavenging induces a vacuum that can cause the side surface of the container to collapse or buckle. Peanut butter and mayonnaise are examples of such products. One solution is to add more weight or thickening ribs to prevent collapse to improve the vacuum performance. Other approaches include a circumferential thickness of material, which creates an internally protruding rib. However, these solutions undesirably increase the container weight.

Another solution may be to provide ribs having about the same thickness to provide a structure to prevent buckling. However, these sort of ribs, by convention, have a symmetrical top to bottom profile. Further, to provide adequate hoop strength to prevent collapse, these ribs have tight corners leading into and out of the profile. While these ribs are used to resist internal pressures on the bottle, they have some drawbacks. In particular, products such as peanut butter, mayonnaise, and other food products are scooped or spatulated from their packaging for final use. The profile and blends (radii) make it difficult to evacuate product, especially products with higher viscosity. That is, it creates a profile below the rib, which makes it difficult to remove all of the product from the package using typical utensils.

Therefore, there is a need for an improved container that provides a structure for good vacuum resistance and product evacuation performance without undue increases in container weight.

SUMMARY OF THE INVENTION

According one aspect of this invention, a rib is provided by indenting the profile of the container to provide a structure that is resistant to deformation. While the top portion of the rib structure is somewhat shallow in depth, and the bottom of the rib has a large tangent radius flowing out of the rib at depth, back to the primary bottle surface.

According to another aspect, a container for storing a food product is provided. The container comprises a top opening for receiving a material; a side portion extending between the top opening and a bottom of the container; and an inward projecting rib disposed on the side portion having an upper portion having a radius of curvature smaller than a bottom portion of the rib.

According to another aspect, the thickness of the side portion of the container is substantially the same as a thickness of rib portion.

According to another aspect, the inward projecting rib has a transition portion between the upper portion and the bottom portion, the transition portion having a radius of curvature less than the upper portion.

According to another aspect, the radius of curvature of the upper portion ranges from 0.04 to 0.12 inches, the radius of curvature of the transition portion ranges from 0.02 to 0.10 inches and the radius of curvature of the bottom portion ranges from 0.50 to 1.0 inches.

BRIEF DESCRIPTION OF THE DRAWINGS

The above and other features and aspects of the present invention will become more apparent by describing in detail non-limiting, exemplary embodiments thereof with reference to the attached drawings in which.

DETAILED DESCRIPTION OF THE EMBODIMENTS

The container according to the present invention according to the non-limiting, exemplary embodiments of the present invention is described below with reference to the accompanying drawings.

Figure 1:
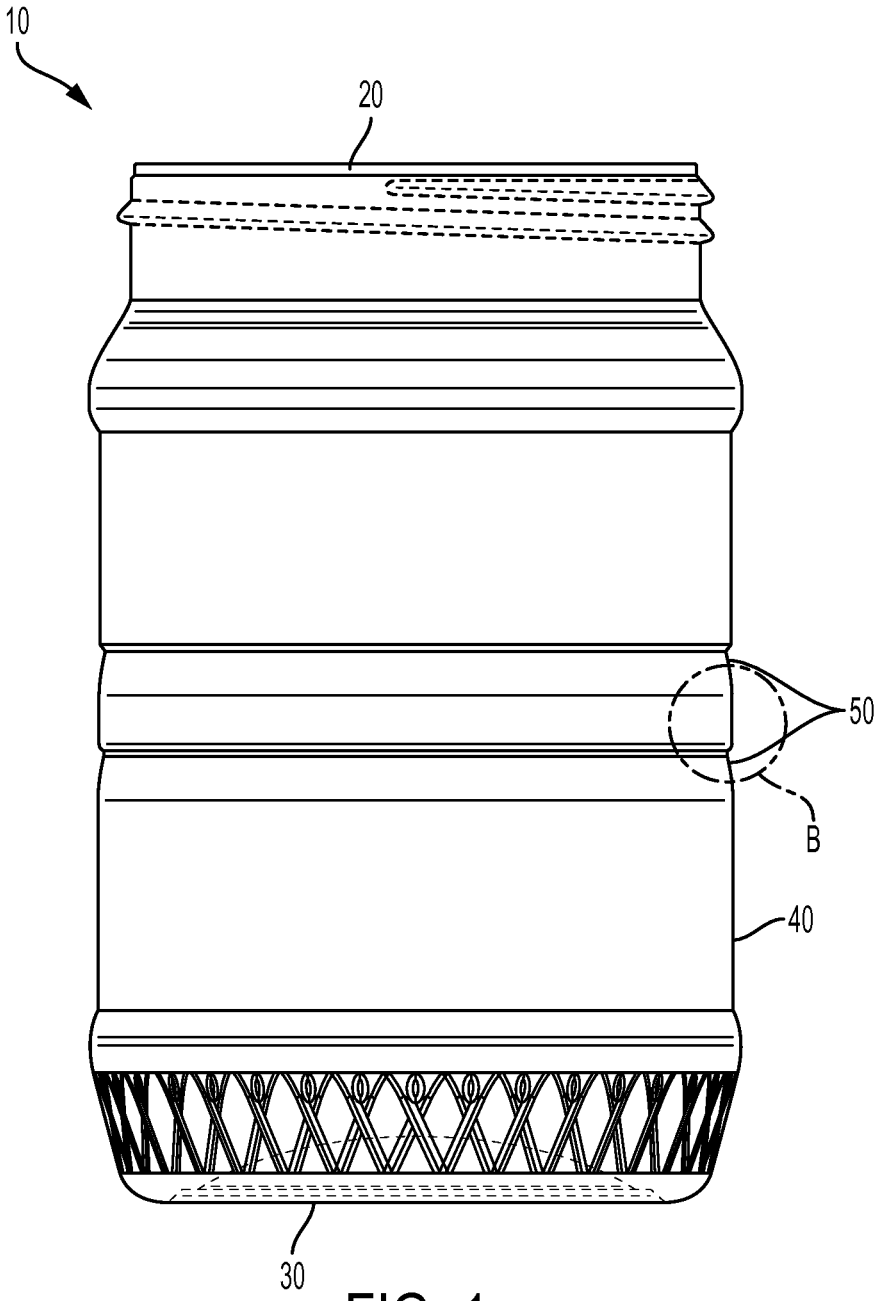
FIG. 1 shows a container having two ribs in accord with an exemplary embodiment.

FIG. 1 shows cylindrical plastic container 10 having a top 20, a bottom 30 and a sidewall 40 extending between the top 20 and bottom 30. A portion of the sidewall 40 has a substantially cylindrical profile. However, this embodiment includes two ribs 50 formed in a center portion of the sidewall 40 to provide increased hoop strength. This increased hoop strength prevents the sidewall 40 from collapsing or buckling due to vacuum or external forces such as when labels are applied to the container 10. Also, because the ribs 50 are formed to have substantially the same thickness as the other portions of the sidewall 40, the container does not exhibit increased weight. While the thickness of the ribs 50 and the sidewall 40 may be identical, some variations in this thickness may occur during forming of the container 10. For example, if the container is blow molded from a preform, some variation in thickness may result as the portions of the preform forming the ribs 50 will not necessarily flow evenly and must expand to form the rib 50.

Figure 2:
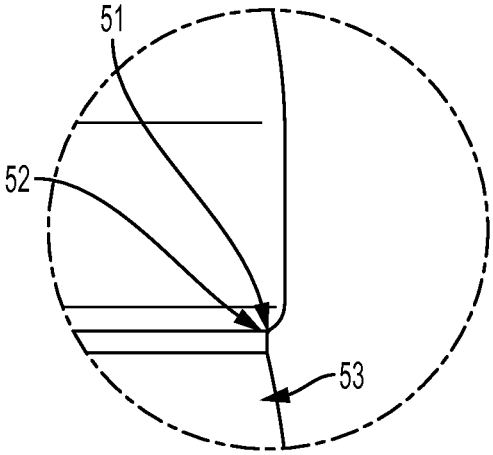
FIG. 2 shows view of detail B of FIG. 1.
Figure 3:
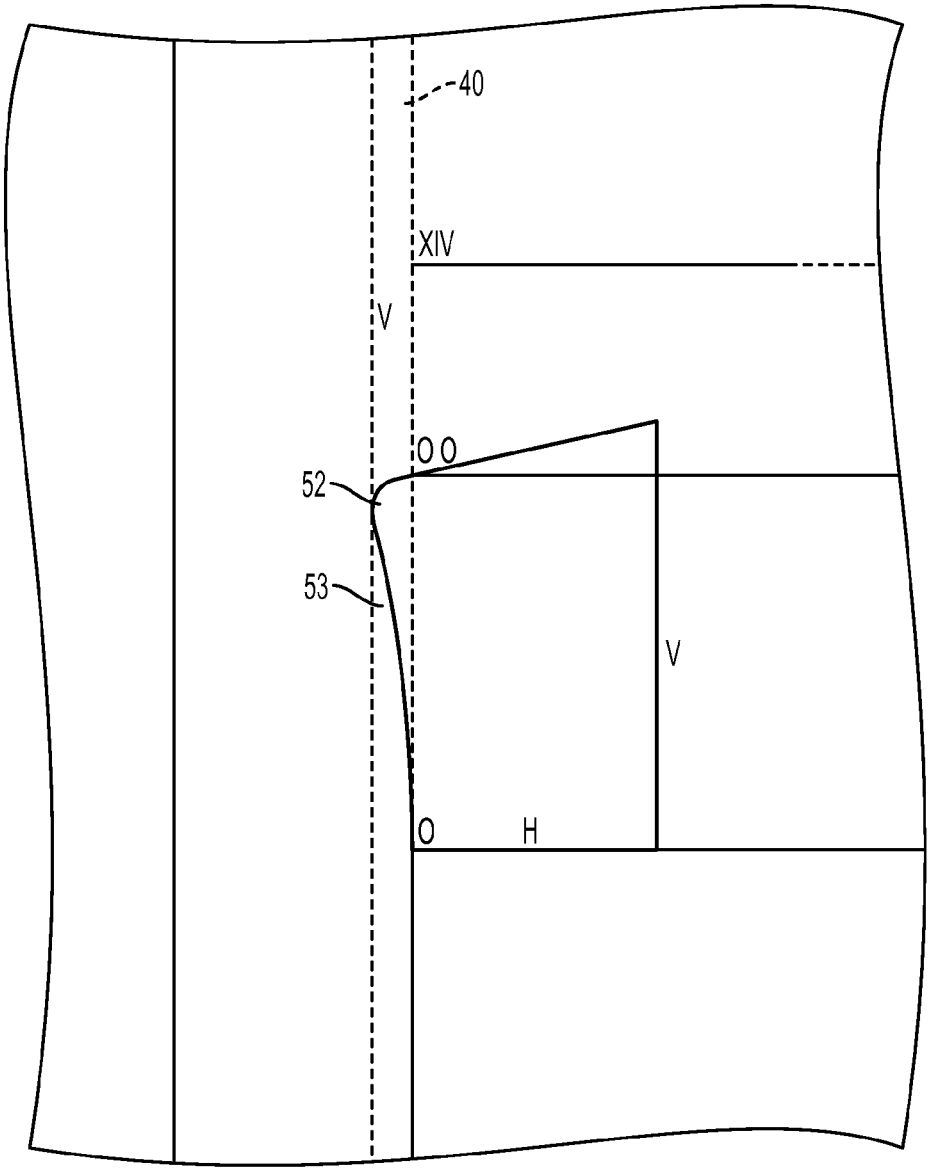
FIG. 3 shows the rib dimensions in accord with another embodiment.

As illustrated in FIGS. 1-3, the ribs 50 extend inwardly toward the center of a container. With reference to FIGS. 2 and 3, in a direction from the top 20 of the container 10 toward the bottom 30, each rib 50 comprises a lead in portion 51, a transition portion 52 and a lead out portion 53. The lead in portion 51 provides a transition area where the sidewall 40 is turned to extend inward toward a center of the container 10. The radius of this lead in portion 51 is typically within the range of 0.04 to 0.12 inches.

Continuous with the lead in portion 51 is a transition portion 52, which functions to turn the sidewall back toward the bottom and ultimately toward the outer circumference of the sidewall 40. The transition portion 52 turns the sidewall back toward the bottom 30 of the container 10 and slightly toward the outer sidewall. The radius of the transition portion 52 is within the range of 0.02 to 0.10 inches.

The transition portion 52 ends at the lead out portion 53, which forms a surface having less curvature than either of the lead in portion 51 or the transition portion 52. The radius of the lead out portion 53 is greater than the other rib portions to facilitate content removal. The radius of the lead out portion 53 is shown in the figures is 0.68 inches, but this radius may range from 0.50 to 1.0 inches. Most preferably, this radius is within the range of 0.68 to 0.75 inches.

Accordingly, as shown in more detail in FIGS. 2 and 3, the rib 50 has an upper concave portion having a gradual radius that transitions to a convex portion having a shorter radius, in this particular embodiment the gradual radius of 0.04 transitions to 0.02. This convex portion (the transition portion 52) transitions to another convex portion (lead out portion 53). As a result, the slope of the surface of the lead in portion 51 with respect to the axial direction of the container 10 is generally steeper than the slope of the surface of the lead out portion 53.

Figure 4:
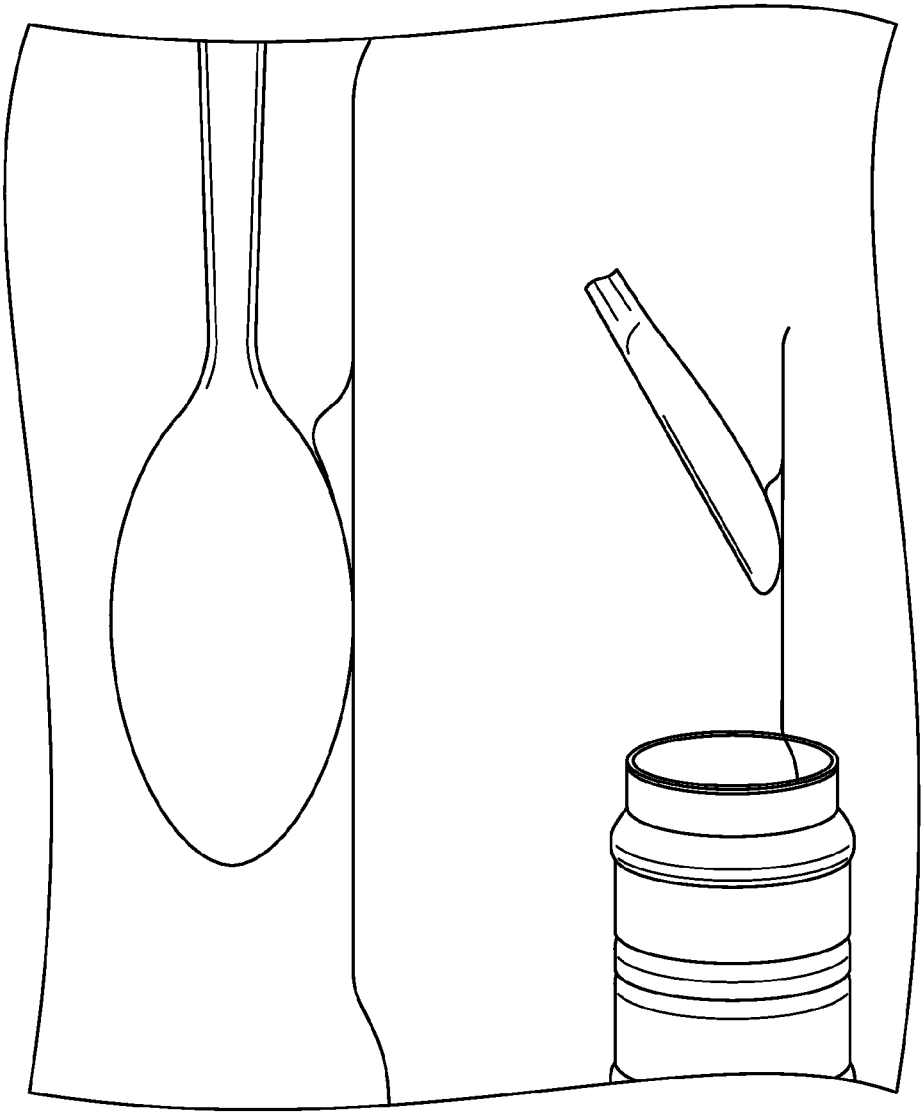
FIG. 4 shows the ergonomic functionality of the rib profile in accord with the exemplary embodiments.

As a result of this configuration, the structure of the lead in portion 51 and the transition portion 52 provide for added hoop strength, whereas the lead out portion 53 provides a curved concave surface. As shown in FIG. 4, the configuration of the lead out portion 53 enables a user to evacuate product using the curved surface of either a spoon or a knife.

While this invention has been particularly shown and described with reference to exemplary embodiments thereof, the above description should be considered in as illustrations of the exemplary embodiments only and are not for purposes of limitation. Therefore, the scope of the invention is defined not by the detailed description of the invention but by the appended claims, and all differences within the scope will be construed as being included in the present invention. Additionally, the features described in the various embodiments are not exclusive in that a feature of one embodiment may be incorporated into another embodiment.

What is claimed is:

1. A container for storing a food product, comprising:

a top opening for receiving a material;

a side portion extending between the top opening and a bottom of the container; and an inward projecting rib disposed on the side portion having an upper portion having a radius of curvature smaller than a radius of curvature of a bottom portion of the rib, wherein the inward projecting rib has a transition portion between the upper portion and the bottom portion, the transition portion having a radius of curvature less than the upper portion, wherein the radius of curvature of the upper portion ranges from 0.04 to 0.12 inches, the radius of curvature of the transition portion ranges from 0.02 to 0.10 inches and the radius of curvature of the bottom portion ranges from 0.50 to 1.0 inches, whereby the lower dimensions of the rib would conform to the profile of an evacuation utensil.

2. The container of claim 1, wherein a thickness of the side portion of the container is substantially the same as a thickness of rib portion.

* * * * *